US005080523A

United States Patent [19]

Steiner

[11] Patent Number: 5,080,523

[45] Date of Patent: Jan. 14, 1992

[54] CONNECTING STONE FOR FORMING ROAD EDGES

[75] Inventor: Alfred Steiner, Andelfingen, Switzerland

[73] Assignee: Waldormills Company Establishment, Vaduz, Liechtenstein

[21] Appl. No.: 668,815

[22] Filed: Mar. 8, 1991

Related U.S. Application Data

[63] Continuation of Ser. No. 483,802, Feb. 23, 1991, abandoned.

[30] Foreign Application Priority Data

Mar. 2, 1989 [CH] Switzerland ..... 787/89-2

[51] Int. Cl.[5] ..... A01G 1/08; F01C 5/04

[52] U.S. Cl. ..... 404/7; 47/33; 52/585; 404/41

[58] Field of Search ..... 52/102, 247, 574, 585, 52/593; 47/33

[56] References Cited

U.S. PATENT DOCUMENTS

| | | | |
|---|---|---|---|
| 449,739 | 4/1891 | Hazelton | 404/41 |
| 1,683,121 | 9/1928 | Baldwin | 404/13 |
| 3,326,099 | 6/1967 | Cova et al. | 256/13.1 |
| 3,343,301 | 9/1967 | Adelman | 52/585 X |
| 4,474,504 | 11/1984 | Whitman et al. | 404/40 |
| 4,498,660 | 2/1985 | Brema et al. | 256/13.1 |
| 4,681,302 | 7/1987 | Thompson | 404/6 |
| 4,869,018 | 9/1989 | Scales et al. | 47/33 |
| 4,982,535 | 1/1991 | Pickett | 52/593 X |

FOREIGN PATENT DOCUMENTS

| | | | |
|---|---|---|---|
| 65199 | 11/1982 | European Pat. Off. | 404/40 |
| 2450475 | 4/1976 | Fed. Rep. of Germany | 52/585 |
| 2622186 | 12/1977 | Fed. Rep. of Germany | 52/585 |
| 2841794 | 4/1980 | Fed. Rep. of Germany | 47/33 |

*Primary Examiner*—David J. Bagnell

*Attorney, Agent, or Firm*—Lewis H. Eslinger; Jay H. Maioli

[57] ABSTRACT

Construction elements each consist of a central section and two external sections, with the central section having, in addition to flat top and bottom surfaces, two parallel side walls and four, shorter side walls arranged at angles relative to the longer side walls. Pairs of the angled side walls would intersect at right angles were they to extend to the two external sections. The two external sections are cylindrical in shape and of a height less than the height of the central section, with the remaining portion of the central section having a cylindrical wall that may be thought of as a continuation of the external section. By providing the external sections with a height less than the central section, it is possible to line up the elements adjacent to each other with the external sections of adjacent construction elements overlapping in order to form a temporary curbstone or traffic control structure.

1 Claim, 2 Drawing Sheets

CONNECTING STONE FOR FORMING ROAD EDGES

This is a continuation of application Ser. No. 483,802, filed Feb. 23, 1990, now abandoned.

BACKGROUND OF THE INVENTION

1. Field of the Invention

This invention relates generally to construction elements such as blocks and, more particularly, to construction elements that can be assembled on a temporary basis and that can be rearranged or disassembled easily without destroying the individual construction elements.

2. Description of the Background

When forming traffic islands or traffic direction barriers, the typical custom is to first provide provisional curbstones in order to test their suitability for directing traffic as desired. If, after a trial phase has been undergone, it is found that accidents occur the lines of the traffic islands or directors are changed until an acceptable solution is found that does not unfavorably affect the flow of traffic.

Once these optimum lines have been found, then the provisional curbstones can be replaced by the final or permanent highway construction.

The need for improved provisional curbstones is ongoing.

OBJECT AND SUMMARY OF THE INVENTION

Accordingly, it is an object of the present invention to provide construction elements that can be assembled to advantageously provide provisional curbstones in a manner improved over those known heretofore.

It is another object of this invention to provide curbstone elements in which the individual elements can be easily assembled and combined, one with another, to create temporary highway boundaries.

According to one aspect of the present invention, a construction element is provided that consists of a central section and two external sections arranged on either end of the central section. The central section has four straight plane surfaces forming the body thereof and at each end thereof has two walls that are angled inwardly relative to the longer side walls. The end walls are angled so that if they were extended they would intersect at right angles at a point that is substantially at the middle of an external section. The two external sections are cylindrical in shape and of a height less than the height of the central section with the remaining end portion of the central section that does not terminate in the external section having a cylindrical wall that may be thought of as a continuation of the cylindrical external section. This cylindrical shape permits the elements to be arranged adjacent each other in an alternating arrangement so as to form a curbstone that can be changed easily at any time or removed without damaging the construction elements, so that they could be subsequently reused.

The above and other objects, features, and advantages of the present invention will become apparent from the following detailed description of illustrative embodiments thereof to be read in conjunction with the accompanying drawings.

DETAILED DESCRIPTION OF PREFERRED EMBODIMENTS

Figure 1:
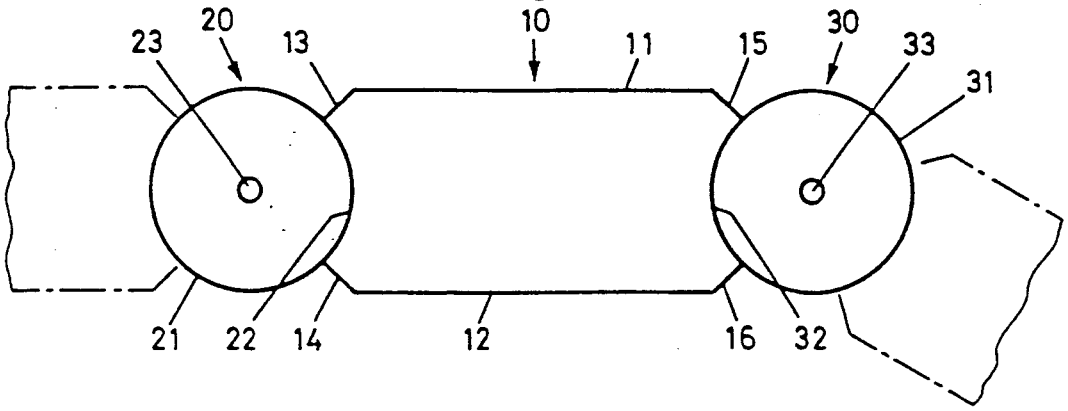
FIG. 1 is a top plan view of a construction element according to an embodiment of the present invention.
Figure 2:
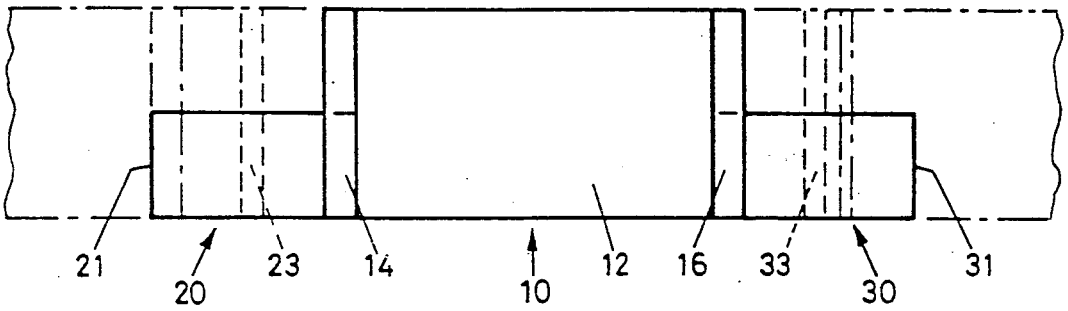
FIG. 2 is a side elevational view of the construction element of FIG. 1.

FIG. 1 is a plan view of a construction element 8 suitable for use with a number of similar elements to form provisional curbstones or traffic boundaries, and FIG. 2 is side elevation of that same construction element. Construction element 8 includes an elongate central section 10 and two identical external cylindrical sections 20 and 30 at either end thereof. Central section 10 is a multi-sided prism having a flat top surface 17 and flat bottom surface 18 and two parallel sides 11 and 12. At both ends of the parallel sides are respective inwardly tapered sides that, if extended, would meet at an angle of substantially 90°. These inwardly tapered sides for angles with the longer side walls 11 and 12 of approximately 140°–145°. More specifically, inwardly sloping sides 13 and 15 are arranged at the respective ends of side wall 11, while inwardly tapered walls 14 and 16 are arranged at the respective ends of side wall 12. The outer edges of these tapered side walls 13, 14, 15, and 16 would extend to pierce external sections 20, 30 in the center but are cut-off by respective cylindrical wall segments 22, 32. Cylindrical wall sections 22, 32 may be thought of as extensions of the cylindrical walls 21, 31 of the two external sections 20, 30, respectively.

As clearly seen in FIG. 2, the height of external cylindrical sections 20, 30, is only approximately one-half the height of central section 10. By providing these dimensions, the external sections 20, 30 can be stacked one upon each other and thereby make the sum equal to the height of the central section 10 and cylindrical walls 21, 31 can lie exactly above each other and fit into cylindrical recesses 23, 32 formed in the ends of central section 10.

FIGS. 1 and 2 show that the construction element 8 has an aspect ratio higher than it is wide.

In addition, external sections 20 and 30 can have central bores 23, 33, respectively, formed therein so that upon alignment of a number of the construction elements 8, as shown in FIG. 2, a steel pin, not shown, an be inserted in the aligned bores 23, 33 to maintain the desired alignment of the construction elements. In addition, the pin can be made longer so that it may by driven into the ground and prevent the construction elements from being misaligned.

Figure 3:
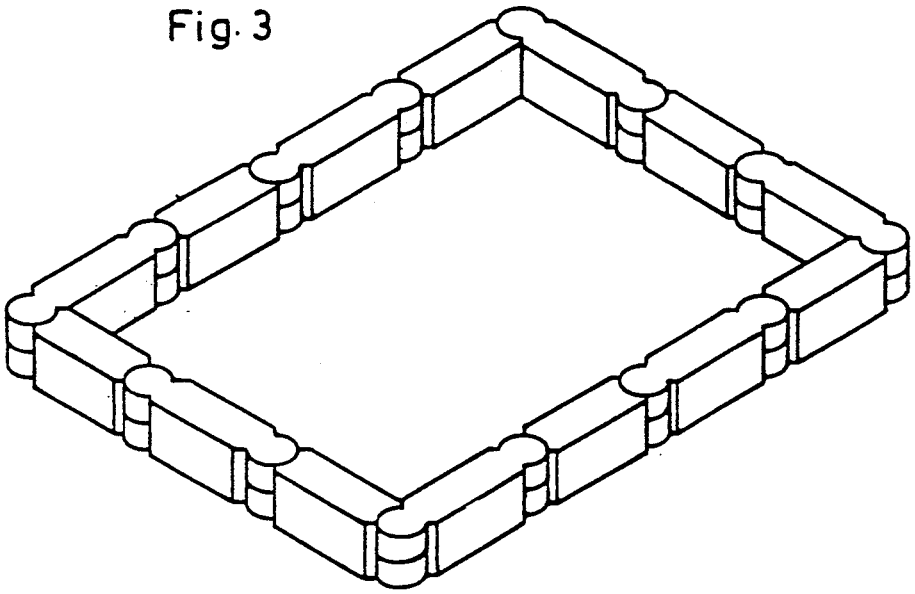
FIG. 3 is a perspective view of a typical traffic island constructed using the embodiment shown in FIG. 1.

FIG. 3 shows a typical construction of a traffic island that can be built using a number of construction elements 8, as shown in FIGS. 1 and 2. As shown in FIG. 3, the respective outer sections 20 and 30 fit into the corresponding recesses 22, 32 formed in adjacent construction elements 8 and the central sections of adjacent elements are then aligned. Steel pins or the like may be inserted into bores 23, 33 in order to maintain correct alignment.

As can be appreciated from FIG. 3, traffic island or curbstones built according to the present invention can be changed at any time in order to permit determination of the best possible layout of the highway director. The construction elements of the present invention can also be built as provisional steps that can be set up immediately until the construction company is able to put up the final construction. In the case that only a temporary traffic direction procedure is required the assembled construction elements ca be retained.

In order to adapt this invention to the formation of so-called dry walls, additional configurations following the present invention are shown in FIGS. 4–7.

Figure 4:
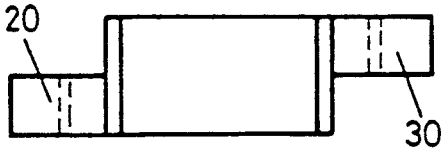
FIG. 4 is a side elevational view of another embodiment of a construction element according to the present invention.

In FIG. 4, a construction element 8′ is similar to that shown in FIG. 1, with the elongate central section 10 being substantially the same and one of the two external cylindrical sections 20 being the same. In construction element 8′ of the embodiment FIG. 4, however, the other external cylindrical section 30′ is rearranged to the upper surface of the central section 10. This displacement of the two external circular sections 20, 30′ results in the alignment of one external section 30′ with the upper surface of the central section and the other of the two external sections 20 being aligned with the lower surface of the central section 10. This permits an interlacing of the construction elements 8′, without turning the elements over, as in FIG. 2.

Figure 5:
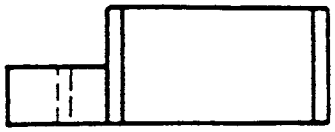
FIG. 5 is a side elevational view of yet another embodiment of a construction element according to the present invention.
Figure 6:
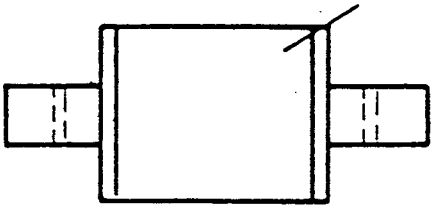
FIG. 6 is a side elevational view of still another embodiment of a construction element according to the present invention.

FIG. 5 discloses an embodiment of a construction element 40 in which only one external section 20 is provided. In the embodiment of FIG. 6 the construction element 50 is provided with a central section 52 that has a height substantially equal to three times the height of the respective external cylindrical sections 54, 56.

Figure 7:
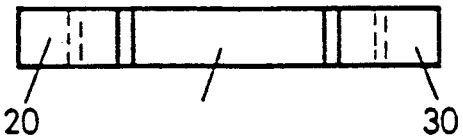
FIG. 7 is a side elevational view of still yet another embodiment of a construction element according to the present invention.

A corollary of the embodiment of FIG. 6 is shown in FIG. 7 in which the central section 62 has a height substantially equal to the height of the two external cylindrical sections 20, 30.

Figure 8:
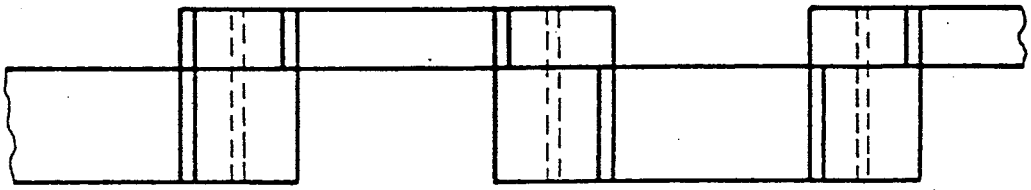
FIG. 8 is a side elevational view of a section of a wall constructed using the embodiment of FIG. 7.

FIG. 8 shows a construction employing an embodiment similar to that shown in FIG. 7 in which the height of the central section is equal to the height of the two external cylindrical sections. In the partial wall construction of FIG. 8 a further embodiment 80 is employed in which the central section 82 and the external cylindrical sections 84, 86 are of equal height and the overall height of all three elements is greater than that of the embodiment of FIG. 7, thereby providing a zigzag or alternating type of wall construction.

Figure 9:
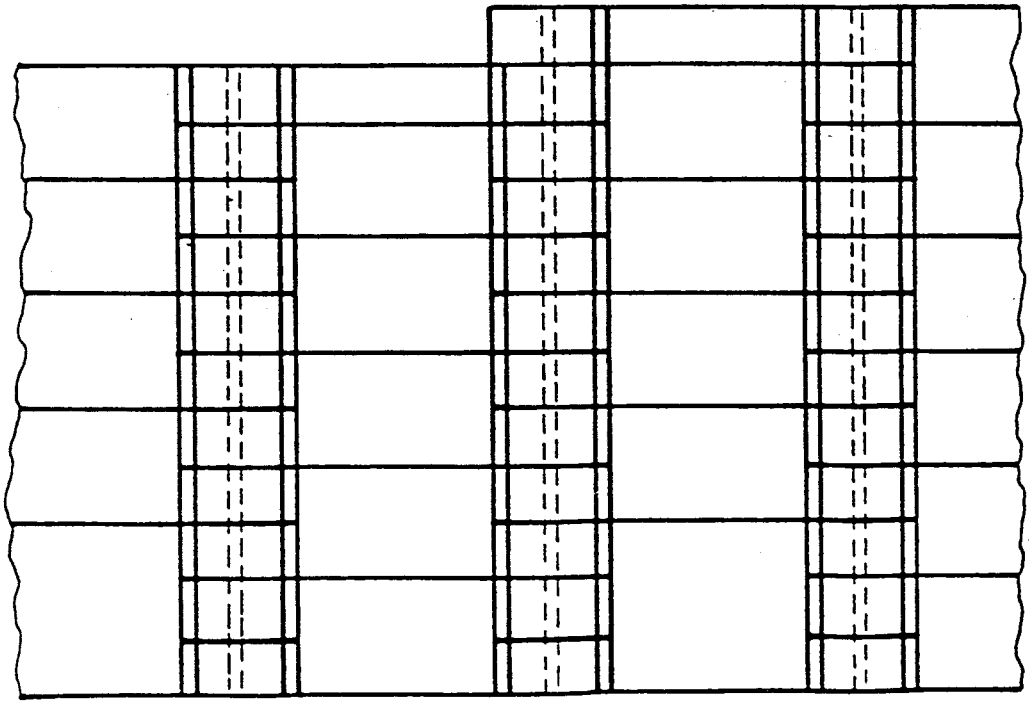
FIG. 9 is a side elevational view of a so-called dry wall formed using the embodiments of FIGS. 2, 6, and 7.

A complete dry wall may be formed according to the present invention and such dry wall construction is shown in FIG. 9 formed of three different construction elements 10, 50, and 60. These construction elements correspond to those shown in FIGS. 1, 6, and 7, respectively. In the wall of FIG. 9, the left-hand column is formed beginning with the construction element 50 of FIG. 6 and then has placed thereon construction elements 8 according to the embodiment of FIGS. 1 and 2. The next column has five construction elements 8 of FIG. 2 that are topped by a construction element 60 of FIG. 7, while the third column is similar to the first column and commences with a construction element 50 of FIG. 6 and proceeds with construction elements 8 of FIG. 2, with a construction element 60 of FIG. 7 at the top. To show the versatility of this arrangements of these construction elements, the final column can consist solely of elements 8 from FIG. 2 or a column such as the second column can be provided to cause the step-like feature of the dry wall to continue.

In place of the central bores in the external sections, the respective male and female parts of a snap fastener can be provided.

The above description is given on preferred embodiments of the invention, but it will be apparent that many modifications and variations could be effected by one skilled in the art without departing from the spirit or scope of the novel concepts of the invention, which should be determined by the appended claims.

What is claimed is:

1. A construction element for combination with other identical construction elements to form road edges, curb stones, and traffic islands, characterized by a connecting stone consisting of three integrally connected sections, an elongate central section and two identical substantially cylindrical sections extending outwardly from the ends of the elongate central section, wherein the central section has two parallel side walls and four, shorter side walls arranged at each end and being angled to converge to meet respective ones of the two substantially cylindrical sections and forming an angle of 145° with the respective side wall and wherein the two substantially cylindrical sections have a height no higher than half the height of the central section and the construction element has an aspect ratio higher than it is wide wherein respective base surfaces of the central section and the two substantially cylindrical sections lie on the same plane, and wherein the two substantially cylindrical sections each have a central bore substantially perpendicular to the base of the central section, whereby a spike can be inserted therein to align two substantially cylindrical sections of said identical construction elements arranged one upon another and to affix said two substantially cylindrical sections to the ground, so that a plurality of said connecting stones are serially arranged and connected to the ground.

* * * * *